US010928127B2

(12) United States Patent
Cardella et al.

(10) Patent No.: US 10,928,127 B2
(45) Date of Patent: Feb. 23, 2021

(54) LARGE-SCALE HYDROGEN LIQUEFACTION BY MEANS OF A HIGH PRESSURE HYDROGEN REFRIGERATION CYCLE COMBINED TO A NOVEL SINGLE MIXED-REFRIGERANT PRECOOLING

(71) Applicant: Linde Aktiengesellschaft, Munich (DE)

(72) Inventors: Umberto Cardella, Baldham (DE); Lutz Decker, Winterthur (CH); Harald Klein, Wolfratshausen (DE)

(73) Assignee: Linde Aktiengesellschaft, Munich (DE)

( * ) Notice: Subject to any disclaimer, the term of this patent is extended or adjusted under 35 U.S.C. 154(b) by 6 days.

(21) Appl. No.: 15/771,435

(22) PCT Filed: Oct. 20, 2016

(86) PCT No.: PCT/EP2016/075214

§ 371 (c)(1),
(2) Date: Apr. 27, 2018

(87) PCT Pub. No.: WO2017/072019

PCT Pub. Date: May 4, 2017

(65) Prior Publication Data

US 2018/0347897 A1 Dec. 6, 2018

(30) Foreign Application Priority Data

Oct. 27, 2015 (EP) ..... 15003070

(51) Int. Cl.
*F25J 1/00* (2006.01)
*F25J 1/02* (2006.01)

(52) U.S. Cl.
CPC ..... *F25J 1/0055* (2013.01); *F25J 1/001* (2013.01); *F25J 1/005* (2013.01); *F25J 1/0042* (2013.01);
(Continued)

(58) Field of Classification Search
CPC .... F25J 1/001; F25J 1/02; F25J 1/0042; F25J 1/0045; F25J 1/0052; F25J 1/0067; F25J 2215/10; F25J 2270/902
See application file for complete search history.

(56) References Cited

U.S. PATENT DOCUMENTS 3,992,167 A * 11/1976 Beddome ..... F25B 9/10 62/639
6,523,366 B1 * 2/2003 Bonaquist ..... F25B 9/002 62/613

(Continued)

FOREIGN PATENT DOCUMENTS

JP 8159654 A 6/1996
JP H08159654 A * 6/1996 ..... F25J 1/001

OTHER PUBLICATIONS

JPH08159654A Translation (Year: 1996).*

(Continued)

*Primary Examiner* — Brian M King
(74) *Attorney, Agent, or Firm* — Millen White Zelano & Branigan, PC; Brion P. Heaney

(57) ABSTRACT

The present invention relates to a method for liquefying hydrogen, the method comprises the steps of: cooling a feed gas stream comprising hydrogen with a pressure of at least 15 bar(a) to a temperature below the critical temperature of hydrogen in a first cooling step yielding a liquid product stream. According to the invention, the feed gas stream is cooled by a closed first cooling cycle with a high pressure first refrigerant stream comprising hydrogen, wherein the high pressure first refrigerant stream is separated into at least two partial streams, a first partial stream is expanded to low pressure, thereby producing cold to cool the precooled feed gas below the critical pressure of hydrogen, and compressed to a medium pressure, and wherein a second partial stream is expanded at least close to the medium pressure and guided into the medium pressure first partial stream.

24 Claims, 3 Drawing Sheets

(52) U.S. Cl.
CPC ..... *F25J 1/0052* (2013.01); *F25J 1/0062* (2013.01); *F25J 1/0065* (2013.01); *F25J 1/0067* (2013.01); *F25J 1/0072* (2013.01); *F25J 1/0092* (2013.01); *F25J 1/0095* (2013.01); *F25J 1/025* (2013.01); *F25J 1/0214* (2013.01); *F25J 1/0215* (2013.01); *F25J 1/0221* (2013.01); *F25J 1/0259* (2013.01); *F25J 1/0268* (2013.01); *F25J 1/0279* (2013.01); *F25J 1/0288* (2013.01); *F25J 1/0291* (2013.01); *F25J 1/0292* (2013.01); *F25J 1/0294* (2013.01); *F25J 2210/42* (2013.01); *F25J 2210/62* (2013.01); *F25J 2215/10* (2013.01); *F25J 2230/04* (2013.01); *F25J 2230/08* (2013.01); *F25J 2230/30* (2013.01); *F25J 2240/40* (2013.01); *F25J 2270/12* (2013.01); *F25J 2270/16* (2013.01); *F25J 2270/90* (2013.01); *F25J 2270/902* (2013.01)

(56) References Cited

U.S. PATENT DOCUMENTS

2008/0196587 A1* 8/2008 Ha ..... F25J 3/0266 95/204
2010/0083695 A1* 4/2010 Kundig ..... F25J 1/001 62/607
2010/0272634 A1* 10/2010 Schwartz ..... C01B 3/0089 423/649
2014/0053598 A1* 2/2014 Ishimaru ..... F25J 1/025 62/606

OTHER PUBLICATIONS

International Search Report PCT/EP2016/075214 dated Jan. 24, 2017.
Gross R et al: "Fluessigwasserstoff Fuer Europa—Die Linde-Anlage in Ingolstadt", Berichte Aus Technik und Wissenschaft, Linde AG. Wiesbaden, DE, No. 71, Jan. 1, 1994 (Jan. 1, 1994), pp. 36-42, XP000447171, ISSN: 0942-332X.
Quack H et al: "Search for the Best Processes to Liquefy Hydrogen in Very Large Plants", Sep. 1, 2012 (Sep. 1, 2012), XP055268718, Retrieved from the Internet [retrieved on Apr. 26, 2016].
Syed M T et al: "An economic analysis of three hydrogen liquefaction systems", International Journal of Hydrogen Energy, Elsevier Science Publishers B.V., Barking, GB, vol. 23, No. 7, Jul. 1, 1998 (Jul. 1, 1998), pp. 565-576, XP004117683, ISSN: 0360-3199, DOI: 10.1016/S0360-3199(97)00101-8.
Ohira K: "A Summary of Liquid Hydrogen and Cryogenic Technologies in Japan's WE-NET Project", Advances in Cryogenic Engineering: Transactions of the Cryogenic Engineering Conference vol. 710, Jan. 1, 2004 (Jan. 1, 2004), pp. 27-34, XP009176256.
K Stolzenburg et al: "Integrated Design for Demonstration of Efficient Liquefaction of Hydrogen (IDEALHY) Fuel Cells and Hydrogen Joint Undertaking (FCH JU)", Dec. 16, 2013 (Dec. 16, 2013), XP055268732, Retrieved from the Internet [retrieved on Apr. 26, 2016].
Authors / et al: Integrated design for demonstration of efficient liquefaction of hydrogen (IDEALHY) Fuel Cells and Hydrogen Joint Undertaking (FCH JU) Grant Agreement No. 278177 Title: Report on Modelling of Large-Scale High-Efficiency IDEALHY Hydrogen Liquefier Concept Partner.
Walnum H T et al: "Principles for the liquefaction of hydrogen with emphasis on precooling processes", Sep. 1, 2012 (Sep. 1, 2012), XP055268716, Retrieved from the Internet [retrieved on Apr. 26, 2016].
Berstad D et al: International Journal of Hydrogen Energy 35 (2010), 4512-4523.

* cited by examiner

LARGE-SCALE HYDROGEN LIQUEFACTION BY MEANS OF A HIGH PRESSURE HYDROGEN REFRIGERATION CYCLE COMBINED TO A NOVEL SINGLE MIXED-REFRIGERANT PRECOOLING

The present invention relates to a method for liquefying hydrogen in large scale.

The method comprises the steps of: providing feed gas stream comprising hydrogen, wherein the feed gas stream has an initial temperature, particularly the ambient temperature, e.g. 288 K to 303 K, and a pressure of at least 15 bar(a), precooling the feed gas stream to an intermediate temperature in a precooling step yielding a precooled feed gas stream, wherein particularly the intermediate temperature is in the range of 70 K to 150 K, and cooling the precooled feed gas stream to a temperature below the critical temperature of hydrogen, particularly below 24 K, more particular below 21.5 K, in a first cooling step yielding a liquid product stream comprising hydrogen.

The known technology is primarily based on process technology for small-scale industrial hydrogen liquefaction plants with a production capacity typically up to 10 tpd (tons per day) LH2 (for example, the Linde Leuna plant, a hydrogen liquefier with 5 tpd capacity). The hydrogen feed is produced outside the battery-limit of the plant from a methane steam reformer or an electrolyser and is fed to the liquefaction plant with a typical feed pressure between 15 bar(a) and 30 bar(a). The evaporation of a liquid nitrogen stream at typically 78 K, the nitrogen saturation temperature for 1.1 bar(a), is used to precool the hydrogen feed from ambient temperature to about 80 K in an aluminium-brazed plate-fin heat exchanger. After this step, the hydrogen feed is conducted through a purifier to remove residual impurities, mainly nitrogen, in an absorber vessel. After the purification at 80 K, the hydrogen feed is allowed to pass through additional plate-fin heat exchanger passages filled with catalyst, typically hydrous ferric oxide, for the ortho to para hydrogen conversion. The feed is then again cooled down to about 80 K by the means of liquid nitrogen.

The final cooling and liquefaction of the hydrogen feed, from about 80 K to the state of saturated or subcooled liquid, is provided by the means of a closed hydrogen Claude loop with typically between one and three cooling strings with turbines expanding the gas from a high pressure (HP) to medium pressure (MP) to provide refrigeration at different temperature levels. A third or the coldest high-pressure refrigeration stream is expanded in a Joule-Thomson valve to a low pressure level (LP) as two-phase gas-liquid stream at the cold end to provide cooling at temperatures below the liquid hydrogen feed stream. The hydrogen feed stream is expanded in a Joule-Thomson valve from supercritical pressures to the desired storage pressure e.g. 1.1 bar(a) (20.3 K), before being stored in a storage tank. The entire refrigeration and liquefaction process is installed within one vacuum insulated cold-box. One, two or more hydrogen compressors, reciprocating pistons, are employed at ambient temperature to compress the respective LP and MP hydrogen refrigerant to the HP level before entering the cold-box and being precooled by the warming LP and MP hydrogen in a closed cycle.

Conceptual process designs for larger hydrogen liquefaction plants, with a production capacity of approximately up to 50 tpd (tons per day), have been published: in Ohlig et al. ("Hydrogen, 4. Liquefaction" Ullmanns's Encyclopedia of Industrial Chemistry, edited by F. Ullmann, Wiley-VCH Verlag, 2013), a closed nitrogen expander refrigeration loop has been proposed as precooling stage for the hydrogen feed. An improved hydrogen Claude cycle is used for the refrigeration and liquefaction of the hydrogen feed. Patents EP 0342250 and JP H 09303954 describe a hydrogen liquefaction using neon in a closed-cycle. In EP 0342250, an open nitrogen stream is used as additional precooling, while the hydrogen feed is expanded into the two-phase region with a dense-fluid expander (piston). In JP H 09303954, the hydrogen feed is only cooled via a closed-neon cycle. Ortho-para catalytic conversion is carried out as described above and additionally in two isothermal converters within a liquid nitrogen and a liquid neon bath, respectively. Similarly to EP 0342250, the final expansion of the hydrogen feed results in a two-phase fluid. The saturated liquid product is separated in a phase separator, while the produced flash gas is warmed up to ambient temperature and compressed together with the feed hydrogen.

Further known technologies include single mixed-refrigerant cooling cycles for industrial gas applications different to hydrogen liquefaction, namely the liquefaction of natural gas (LNG), such as U.S. Pat. Nos. 4,033,735, 5,657,643 and in Bauer (StarLNG (TM): a Family of Small-to-Mid-Scale LNG Processes, Conference paper, 9th Annual Global LNG Tech Summit 2014: March 2014). These mixed-refrigerants are typically composed of 5 to 7 fluid components to liquefy a natural gas feed from ambient temperature to approximately 120 K. In the IDEALHY study (2012, http://www.idealhy.eu), a hydrogen liquefaction process with a mixed-refrigerant cycle with up to seven fluid components is used as a method for precooling the hydrogen down to 132 K. An additional closed-loop Brayton cycle with a helium-neon mixture cools the hydrogen feed stream before the latter is expanded into the two-phase region, similarly to EP 0342250 and JP H 09303954.

However, the hydrogen feed obtained by the above described methods generates a high fraction of flash gas after the expansion from supercritical to storage pressure, thus requiring an additional recycle compressor at ambient temperature.

An additional technical difficulty in the up-scaled hydrogen liquefiers is the design of efficient turbo-expanders and compressors in the refrigeration cycle. For liquefaction rates above 50 tpd, the hydrogen refrigeration cycle design in the prior art is practically limited through the maximum volumetric flow (frame size) of available reciprocating compressors. Two or three very large reciprocating compressors running in parallel can be operated and maintained. However, a higher number of parallel running very large machines is not industrially viable due to economical and operational disadvantages e.g. increased installation costs, additional land requirements, high plant maintenance complexity and downtimes. This is also the case for helium refrigeration cycles, because of the limited maximum capacity of helium reciprocating compressors and the low isentropic efficiencies of available helium screw-compressors. Turbo-compressors allow for higher volumetric suction flows. However, at suction temperatures close to ambient, stage pressure ratios for light gases such as helium and hydrogen are low for blade tip speeds that are feasible today. Multi-stage turbo-compressors are designed with up to 6 or 8 stages. Thus, the pressure ratios in cold refrigeration cycles containing pure helium and hydrogen require turbo-compressors with an unfavourable or even not viable high number of compressor stages.

For the cold refrigeration cycle, turbo-expanders with high isentropic efficiencies which are designed with energy recovery, e.g. via turbo-generators or booster compressors, are crucial to increase the overall process efficiency. However, energy and cost efficient turbo-expanders are currently limited by feasible rotational speeds and available frame-sizes.

Currently known closed-loop precooling cycles for hydrogen liquefiers show deficiencies in either energy-efficiency or capital costs (high process complexity). Closed-loop nitrogen expander cycles as described in Ohlig et al. can reach cooling temperatures below 80 K but are characterized by a relatively high number of additional rotating machines and a significantly lower thermodynamic efficiency compared to single mixed-refrigerant cycles.

Additionally, known mixed-refrigerant cycles for natural gas or hydrogen liquefaction applications can increase precooling efficiency but are typically designed for relatively high precooling temperatures (>120 K), thus shifting the generation of the required cooling duty to the colder, more inefficient refrigeration cycle in a hydrogen liquefier. Additionally, known refrigerant mixtures have been designed with a high number of fluid components e.g. 5 to 7. These have to be regularly imported to the hydrogen liquefier plant for inventory make-up and require additional storage tanks for each component, thus increasing operational complexity and handling.

Furthermore, refrigeration fluids providing cooling down to temperatures below approximately 60 K and close to the liquid hydrogen product are limited to hydrogen, helium and neon as well as to mixtures of these. Both the normal boiling point (27.1 K) and melting point (24.6 K) of neon are higher than the normal boiling point of hydrogen (20.3 K). Hence, in order to avoid freeze-out within the process equipment, cold refrigeration cycles with pure neon or with mixtures including neon are not designed to reach cooling temperatures close to or lower than 24.6 K.

Thus, it is the objective of the present invention to provide an efficient and economic method for liquefying hydrogen that is particularly suitable for large scale operation.

This objective is attained by the method according to claim 1.

According thereto, the precooled feed gas stream is cooled by a closed first cooling cycle with a first refrigerant stream comprising hydrogen, particularly in a first cooling zone, wherein the first cooling cycle comprises the steps of:

- providing the first refrigerant stream with a first pressure, wherein the first pressure is at least 25 bar(a),
- separating the first refrigerant stream at least into a first partial stream and a second partial stream,
- expanding the first partial stream in a first expansion device to a second pressure yielding a partially expanded first partial stream, wherein the second pressure is at least 6 bar(a),
- guiding the partially expanded first partial stream and the second partial stream such that heat can indirectly be transferred between the partially expanded first partial stream and the second partial stream, thereby particularly cooling the second partial stream,
- expanding the second partial stream in a second expansion device to a third pressure yielding an expanded second partial stream, wherein the third pressure is below the second pressure,
- guiding the expanded second partial stream and the precooled feed gas stream such that heat can indirectly be transferred between the expanded second partial stream and the precooled feed gas stream, thereby particularly cooling the precooled feed gas stream below the critical temperature of hydrogen,
- compressing the expanded second partial stream from the third pressure to a pressure close or equal to the second pressure yielding a partially expanded second partial stream,
- merging the partially expanded second partial stream and the partially expanded first partial stream to a partially expanded first refrigerant stream, and
- compressing the partially expanded first refrigerant stream to the first pressure yielding the first refrigerant stream.

Alternatively, the first refrigerant stream may comprise helium. The first refrigerant stream may comprise hydrogen and helium.

Advantageously, the method of the invention enables a thermodynamically and economically efficient liquefaction of hydrogen on a large-scale, with production capacities of up to 10 to 20 times above conventional liquefiers, e.g. 150 tpd per liquefier train. Specific energy consumption, and thus, operational costs are significantly reduced compared to prior concepts described above, while utilizing process equipment and frame sizes that are commercially available. Compared to prior published studies for large-scale liquefiers, the method of the invention requires significantly reduced rotating equipment count and a lower number of imported refrigerant fluids, thus reducing the plant operational complexity and capital costs, as well as increasing plant availability and maintainability. Particularly the cooling of the second partial stream by the partially expanded first partial stream enables to reach the required low temperatures in the expanded second partial stream to liquefy and sub cool the precooled feed gas stream. Also, by expanding the first partial stream only to a comparatively high medium pressure e.g. 9 bar(a), the required duty for compressing the refrigerant is significantly reduced. In this way, the compressor power duty is shifted from the medium pressure to high pressure compressor to the low pressure to medium pressure compressor, thus reducing the load and volumetric flow on the larger medium pressure to high pressure compressor, which is usually the frame-size limited machine. Also, increasing the compressor duty (frame-size) of the smaller LP to MP compressor will typically yield a higher compressor efficiency and a lower specific capital cost for the compressor The term "indirectly heat transfer" in the context of the present specification refers to the heat transfer between at least two fluid streams that are spatially separated such that the at least two fluid stream do not merge or mix but are in thermal contact, e.g. two fluid streams are guided through two cavities, for example of a plate heat exchanger, wherein the cavities are separated from each other by a wall or plate, and both streams do not mix but heat can be transferred via the wall or the plate.

Particularly, the feed gas stream is has a hydrogen concentration of at least 99.99 Vol. %.

Particularly, a first pressure is close to a second pressure if both pressures do not differ more the 10% or not more than 5 bar(a), 4 bar(a), 3 bar(a), 2 bar(a) or 1 bar(a) from each other.

In certain embodiments, the expanded second partial stream is guided against the precooled feed gas stream in the first cooling zone such that heat can indirectly be transferred between the expanded second partial stream and the precooled feed gas stream.

In certain embodiments, the first refrigerant stream comprises at least 80 mol. % hydrogen. In certain embodiments, the first refrigerant comprises at least 90 mol. % hydrogen. In certain embodiments, the first refrigerant consists of hydrogen. In certain embodiments, the first refrigerant stream comprises or consists of 80 mol. % to 100 mol. % hydrogen. The first refrigerant stream may also include helium and/or neon. The concentration of helium and/or neon may be up to 20 mol. %. In certain embodiments, the first refrigerant stream comprises or consists of 80 mol. % to 100 mol. % hydrogen, and optionally helium. In certain embodiments, the first refrigerant stream comprises or consists of 80 mol. % to 100 mol. % hydrogen, and optionally neon. In certain embodiments, the first refrigerant stream comprises 89 mol. % hydrogen. The first refrigerant may also comprise neon, wherein the concentration of neon may be variable, but is preferably in a concentration up to 11 mol. %. In certain embodiments, the first refrigerant stream consists of 89 mol. % hydrogen. The first refrigerant may also comprise neon. In certain embodiments, hydrogen comprised within the first refrigerant stream has a content of para hydrogen of around 25%. In certain embodiments, the first refrigerant comprises besides hydrogen, neon and/or helium. The first refrigerant may comprise less than 1 ppm other solidifiable fluids.

In certain embodiments, the first pressure is in the range of 30 bar(a) to 70 bar(a). In certain embodiments, the first pressure is in the range of 30 bar(a) to 60 bar(a). In certain embodiments, the first pressure is in the range of 60 bar(a) to 75 bar(a). In certain embodiments, the second pressure is in the range of 6 bar(a) to 12.9 bar(a). In certain embodiments, the second pressure is in the range of 7 bar(a) to 12.9 bar(a). In certain embodiments, the second pressure is in the range of 8 bar(a) to 11 bar(a). In certain embodiments, the third pressure is in the range of 1 bar(a) to 5 bar(a).

In certain embodiments, the first refrigerant stream comprises essentially helium. The first pressure may be in the range of 25 bar(a) to 100 bar(a), preferably in the range of 50 bar(a) and 70 bar(a), and the second pressure is in the range of 12 bar(a) and 25 bar(a).

In certain embodiments, the expanded second partial stream and/or the partially expanded first refrigerant stream is compressed with a compressor suction temperature. The compressor suction temperature may be one of the following: close to the ambient temperature; or a temperature in the range of 230 K to 313 K; or a temperature in the range of 120 K to 230 K, particularly 150 K; or a temperature in the range of 80 K to 120 K; or a temperature in the range of 30 K to 80 K. The expanded second partial stream and/or the partially expanded first refrigerant stream may be compressed after being warmed to the temperature in a heat exchanger. In certain embodiments, the partially expanded first refrigerant stream and/or the expanded second partial stream is compressed in a multi stage compressor comprising at least two compressor stages or in an ionic liquid piston compressor. The multi-stage compressor may have three compressor stages, optionally with intercooling (in the case of near ambient temperature compression), Advantageously, an ionic liquid piston compressor can be employed for compressing the expanded second partial stream and/or the partially expanded first refrigerant stream if the second refrigerant stream essentially comprises helium. For cold-compression of the expanded second partial stream and/or the partially expanded first refrigerant stream, one or two multi stage turbo-compressor(s) are preferred. In this case, the compressor suction temperature may be in the range of 80 K to 120 K, or in the range of 120 K to 230 K.

An ionic liquid piston compressor in the context of the present specification particularly refers to a compressor, in which at least one or all conventional metal pistons are replaced by a nearly incompressible ionic liquid, wherein particularly the gas is compressed in the cylinder of the compressor by the up-and-down motion of the liquid column, similar to the reciprocating motion of an ordinary piston.

In certain embodiments, the partially expanded first refrigerant stream and/or the expanded second partial stream is compressed in at least one multi-stage reciprocating compressor. The arrangement may include two or three multi-stage reciprocating compressors running in parallel configuration e.g. 2×100% (capacity) or 2×100% (capacity) and 1×50% (capacity). Particularly for cold-compression of the partially expanded first refrigerant stream and/or the expanded second partial stream one or two multi stage turbo-compressor(s) are preferred. The suction temperature may be in the range of 80 K to 120 K, or in the range of 120 K to 230 K.

In certain embodiments, the first refrigerant stream is further separated at least into a third partial stream, and optionally a fourth partial stream. In other words the first refrigerant stream may be further separated into a third partial stream; or the first refrigerant stream may be further separated into a third partial stream and a fourth partial stream. the third partial stream, and optionally the fourth partial stream, is expanded in a third expansion device, and optionally in a fourth expansion device, respectively, particularly to a pressure close or equal to the second pressure, yielding a partially expanded third partial stream, and optionally a partially expanded fourth partial stream. In other words, the third partial stream may be expanded in a third expansion device, preferably to a pressure close or equal to the second pressure, yielding a partially expanded third partial stream. When a fourth partial stream is provided, the fourth partial stream may be expanded in a fourth expansion device, preferably to a pressure close or equal to the second pressure, to form a partially expanded fourth partial stream. The partially expanded first partial stream and the partially expanded third partial stream, and optionally partially the expanded fourth partial stream, may be merged to produce a combined partially expanded partial stream. The combined partially expanded partial stream and the partially expanded second partial stream may be merged to produce the partially expanded first refrigerant stream. The partially expanded first refrigerant stream may be compressed to the first pressure yielding the first refrigerant stream.

In certain embodiments, the first partial stream is expanded in the first expansion device to a first intermediate pressure yielding an intermediate first partial stream. The intermediate first partial stream may be further expanded in the first expansion device to form the partially expanded first partial stream. The intermediate first partial stream and the second partial stream and/or the partially expanded first partial stream may be guided such that heat can indirectly be transferred between the intermediate first partial stream and the second partial stream and/or the partially expanded first partial stream, thereby preferably cooling the second partial stream.

In certain embodiments, the first expansion device comprises at least one turbo-expander. In certain embodiments, the first expansion device comprises at least two turbo expanders, wherein particularly the first partial stream is expanded in a first turbo-expander of the first expansion device to the intermediate pressure and further to the second pressure in a second turbo-expander of the first expansion device.

In certain embodiments, the second expansion device comprises at least one turbo-expander. In certain embodiments, the second expansion device comprises a turbo expander and a throttle valve, wherein particularly the second partial stream is expanded in the turbo-expander of the second expansion device to an intermediate pressure and further to the second pressure in the throttle valve of the second expansion device.

In certain embodiments, the third expansion device comprises at least one turbo-expander. In certain embodiments, the third expansion device comprises at least two turbo expanders, wherein particularly the third partial stream is expanded in a first turbo-expander of the third expansion device to an intermediate pressure and further to the second pressure in a second turbo-expander of the third expansion device.

In certain embodiments, the fourth expansion device comprises at least one turbo-expander. In certain embodiments, the fourth expansion device comprises at least two turbo expanders, wherein particularly the fourth partial stream is expanded in a first turbo-expander of the fourth expansion device to an intermediate pressure and further to the second pressure in a second turbo-expander of the fourth expansion device.

In certain embodiments, the expanded second partial stream is compressed from the third pressure to the pressure equal or close to the second pressure by means of at least one reciprocating piston compressor, particularly two or three reciprocating piston compressors, particularly at any suction temperature. Particularly for cold-compression of the expanded second partial stream one or two multi stage turbo-compressor are preferred, particularly at a suction temperature in the range of 80 K to 120 K, or in the range of 120 K to 230 K.

In certain embodiments, the partially expanded first partial stream and the precooled feed gas stream and/or the first refrigerant stream are guided such that heat can be transferred between the partially expanded first partial stream and the precooled feed gas stream and/or the first refrigerant stream, thereby particularly cooling the precooled feed gas stream and/or the first refrigerant stream, particularly in the first cooling zone. In certain embodiments, the partial expanded first partial stream is guided against the precooled feed gas stream and/or the first refrigerant stream in the first cooling zone such that heat can indirectly be transferred between the partially expanded first partial stream and the precooled feed gas stream and/or the first refrigerant stream.

In certain embodiments, the combined partially expanded stream and the precooled feed gas stream and/or the first refrigerant stream are guided such that heat can indirectly be transferred between the combined partially expanded stream and the precooled feed gas stream and/or the first refrigerant stream, thereby particularly cooling the precooled feed gas stream and/or the first refrigerant stream, particularly in the first cooling zone. In certain embodiments, the combined partially expanded stream is guided against the precooled feed gas stream and/or the first refrigerant stream in the first cooling zone such that heat can indirectly be transferred between the combined partially expanded stream and the precooled feed gas stream and/or the first refrigerant stream.

In certain embodiments, the partially expanded third partial stream and the precooled feed gas stream and/or the first refrigerant stream are guided such that heat can be transferred between the partially expanded third partial stream and the precooled feed gas stream and/or the first refrigerant stream, thereby particularly cooling the precooled feed gas stream and/or the first refrigerant stream, particularly in the first cooling zone. In certain embodiments, the partially expanded third partial stream is guided against the precooled feed gas stream and/or the first refrigerant stream in the first cooling zone such that heat can indirectly be transferred between the partially expanded third partial stream and the precooled feed gas stream and/or the first refrigerant stream.

In certain embodiments, the partially expanded fourth partial stream and the precooled feed gas stream and/or the first refrigerant stream are guided such that heat can be transferred between the partially expanded fourth partial stream and the precooled feed gas stream and/or the first refrigerant stream, thereby particularly cooling the precooled feed gas stream and/or the first refrigerant stream, particularly in the first cooling zone. In certain embodiments, the partially expanded fourth partial stream is guided against the precooled feed gas stream and/or the first refrigerant stream in the first cooling zone such that heat can indirectly be transferred between the partially expanded fourth partial stream and the precooled feed gas stream and/or the first refrigerant stream.

In certain embodiments, the first cooling zone is located within at least one heat exchanger, in which particularly the expanded second partial stream is guided with the hydrogen feed stream. In certain embodiments, the at least one heat exchanger comprises a catalyst, the catalyst being able to catalyse the ortho to para conversion of hydrogen. The feed gas stream may be guided through the at least one heat exchanger such that the feed gas stream contacts the catalyst.

In certain embodiments, the intermediate temperature is in the range of 70 K to 150 K. In certain embodiments, the intermediate temperature is in the range of 80 K to 120 K. In certain embodiments, the intermediate temperature is in the range of 85 K to 120 K. In certain embodiments, the intermediate temperature is in the range of 90 K to 120 K. In certain embodiments, the intermediate temperature is 100 K. In certain embodiments, the intermediate temperature is in the range of 120 K to 150 K. In certain embodiments, the feed gas stream is precooled to the intermediate temperature in a precooling zone. In certain embodiments, the precooling zone is located within an at least one precooling heat exchanger or in a block of the above-mentioned at least one heat exchanger. In certain embodiments, the at least one precooling heat exchanger is a plate heat exchanger or a coil-wound heat exchanger.

In certain embodiments, the feed gas stream is precooled to an intermediate temperature above 80 K, particularly in the range of 85 K to 120 K, more particularly 100 K, yielding the precooled feed gas stream. The precooled feed gas stream may be brought into contact with a catalyst being able to catalyse the ortho to para conversion of hydrogen, particularly before the first cooling step. In certain embodiments, the catalyst is or comprises hydrous ferric oxide. In certain embodiments, the catalyst is arranged within a heat exchanger, particularly within the at least one precooling heat exchanger or the block of the above-mentioned at least one heat exchanger, in which the feed gas stream is precooled.

In certain embodiments, residual impurities, particularly nitrogen and/or oxygen, are removed from the precooled feed gas stream before the precooled feed stream contacts with the above-mentioned catalyst. Preferably the residual impurities are removed by means of an adsorber. In certain embodiments, an adiabatic or isothermal ortho-para catalytic converter vessel is placed directly downstream or within the adsorber, wherein normal-hydrogen comprised within the feed gas stream is converted in a first step to a para-content near the equilibrium at the intermediate temperature, e.g. 39% at 100 K.

In certain embodiments, the feed gas stream is precooled in the precooling step by a closed precooling cycle with a second refrigerant stream, wherein the second refrigerant stream is expanded, thereby producing cold. The second refrigerant stream may comprise or consist of nitrogen, a mixture of $C_1$-$C_5$ hydrocarbons, or a mixture of nitrogen and $C_1$-$C_5$ hydrocarbons.

In certain embodiments, the second refrigerant stream consists of a liquid nitrogen stream, wherein the liquid nitrogen stream is expanded or evaporated, thereby cooled, particularly to a temperature in the range of 70 K to 80K. The cool expanded or evaporated nitrogen stream and the feed gas stream and/or the first refrigerant stream may be guided such that heat can indirectly be transferred between the expanded nitrogen stream and any one or all of the aforementioned streams, thereby particularly precooling the feed gas stream and/or the first refrigerant stream, particularly in the above mentioned at least one precooling heat exchanger or the block of the above-mentioned at least one heat exchanger. In certain embodiments, the expanded or evaporated nitrogen stream is released into the environment after precooling the above-mentioned stream. In certain embodiments, the liquid nitrogen stream is expanded, particularly in a turbo expander and a throttle valve, and compressed in a closed cycle. In certain embodiments, the expanded or evaporated nitrogen stream is guided against the feed gas stream and/or the first refrigerant stream in the precooling zone.

In certain embodiments, the second refrigerant stream consists of a liquid natural gas stream. The liquid natural gas stream may be expanded or evaporated, thereby cooled, preferably to a temperature in the range of 110 K to 150 K. The expanded or evaporated natural gas stream and the feed gas stream and/or the first refrigerant stream may be guided such that heat can indirectly be transferred between the expanded or evaporated natural gas stream and any one or all of the aforementioned streams, thereby particularly precooling the feed gas stream and/or the first refrigerant stream, particularly in the above mentioned at least one precooling heat exchanger or the block of the above-mentioned at least one heat exchanger. After precooling the aforementioned streams, the expanded (or evaporated) natural gas stream can be guided into a supply line or to a process consuming natural gas. In certain embodiments, the expanded (or evaporated) natural gas stream is guided against the feed gas stream and/or the first refrigerant stream in the precooling zone.

In certain embodiments, the $C_1$-$C_5$ hydrocarbon is selected from the group comprised of methane, ethane, ethylene, n-butane, isobutane, propane, propylene, n-pentane, isopentane and 1-butene.

In certain embodiments, the second refrigerant is a single-mixed refrigerant comprising or consisting of four components, wherein a first component is nitrogen, or optionally nitrogen in a mixture with neon and/or argon, a second component is methane, a third component is ethane or ethylene, and a fourth component is n-butane, isobutane, 1-butene, propane, propylene, n-pentane or isopentane.

In certain embodiments, the second refrigerant comprises a fifth component, wherein the fifth component is n-butane, isobutane, propane, propylene, n-pentane or isopentane provided the fifth component is different from the fourth component, e.g. the fifth component can be n-butane, isobutane, propane, propylene or n-pentane if the fourth component is isopentane.

In certain embodiments, the second refrigerant comprises a sixth component, wherein the sixth component is n-butane, isobutane, propane, propylene, n-pentane or isopentane provided the sixth component differs from the fourth component and fifth component, e.g. the sixth component can be, isobutane, propane, propylene or n-pentane if the fourth component is isopentane and the fifth component is n-butane.

In certain embodiments, the third component of the second refrigerant is ethane. Such composition of the second refrigerant is particularly useful if the intermediate temperature to be achieved in the precooling step is below or equal to 100 K. In certain embodiments, third component is ethylene. Such composition of the second refrigerant is particularly useful if the intermediate temperature to be achieved in the precooling step is above 100 K.

In certain embodiments, the fourth component of the second refrigerant, and optionally the fifth component, is isobutane, propane, propylene or isopentane, provided that the fifth component is different from the fourth component. Such composition of the second refrigerant is particularly useful if the intermediate temperature to be achieved in the precooling step is below 100 K.

In certain embodiments, the first component of the second refrigerant is nitrogen in a mixture with neon and/or argon, the second component is methane, the third component is ethane or ethylene, and the fourth component is n-butane, isobutane, 1-butene propane, propylene, n-pentane or isopentane. Such composition of the second refrigerant is particularly useful if the intermediate temperature to be achieved in the precooling step is below 100 K In certain embodiments, the second refrigerant comprises 18 mol. % to 23 mol. % nitrogen, and/or 27 mol. % to 29 mol. % methane, and/or 24 mol. % to 37 mol. % ethane, and/or 18 mol. % to 24 mol. % isopentane or isobutane, provided that the sum of the concentrations of the above-mentioned components does not exceed 100 mol %. Such composition of the second refrigerant stream is particularly useful if the intermediate temperature to be achieved in the precooling step is around 100 K.

In certain embodiments, the second refrigerant consists of 18 mol. % nitrogen, 27 mol. % methane, 37 mol. % ethane and 18 mol. % isopentane. Such composition of the second refrigerant stream is particularly useful if the intermediate temperature to be achieved in the precooling step is around 100 K.

In certain embodiments, the second refrigerant consists of 23 mol. % nitrogen, 29 mol. % methane, 24 mol. % ethane, and 24 mol. % isobutane. Such composition of the second refrigerant stream is particularly useful if the intermediate temperature to be achieved in the precooling step is around 100 K.

In certain embodiments, the precooling step comprises the steps of:

providing the second refrigerant with a fourth pressure, expanding the second refrigerant stream in a fifth expansion device to a fifth pressure yielding an expanded second refrigerant stream, guiding the expanded second refrigerant stream and the feed gas stream such that heat can indirectly be transferred between the expanded second refrigerant stream and the feed gas stream, thereby particularly cooling the feed gas stream to the intermediate temperature, and compressing the expanded second refrigerant to the fourth pressure in a first precooling compressor to the second refrigerant.

In certain embodiments, the expanded second refrigerant stream is guided against the feed gas stream such that heat can indirectly be transferred between the expanded second refrigerant stream and the feed gas stream, particularly in the precooling zone, thereby particularly cooling the feed gas stream to the intermediate temperature.

In certain embodiments, the fourth pressure is in the range of 20 bar(a) to 75 bar(a). In certain embodiments, the fourth pressure is in the range of 20 bar(a) to 60 bar(a), the fourth pressure is in the range of 60 bar(a) to 75 bar(a). In certain embodiments, the fifth pressure is in the range of 1.1 bar(a) to 8 bar(a). In certain embodiments, the expanded second refrigerant stream is characterized by a temperature in the range of 70 K to 150 K, preferably in the range of 70 k to 120 K, more preferable in the range of 80 K to 120 K, most preferable in the range of 90 K to 120 K. In certain embodiments, the expanded second refrigerant stream and the first refrigerant stream and/or the second refrigerant stream are guided such that heat can indirectly be transferred between the expanded second refrigerant stream and the first refrigerant stream and/or the second refrigerant stream, thereby particularly precooling the first refrigerant stream and/or the second refrigerant stream, particularly in the precooling zone. In certain embodiments, the fifth expansion device is a throttle valve. In certain embodiments, the expanded second refrigerant stream is guided against the feed gas stream, the first refrigerant stream and/or the second refrigerant stream in the precooling zone such that heat can be indirectly be transferred between the expanded second refrigerant stream and the feed gas stream, the first refrigerant stream and/or the second refrigerant stream.

In certain embodiments, compressing the second refrigerant comprises the steps of:

compressing the expanded second refrigerant stream in a first precooling compressor or a first compressor stage of the first precooling compressor to an intermediate pressure yielding a intercooled second refrigerant stream, separating the intercooled second refrigerant stream into a mainly liquid second refrigerant stream and a mainly gaseous second refrigerant stream, wherein the mainly liquid second refrigerant stream is pumped to the fourth pressure, and the mainly gaseous second refrigerant stream is compressed in a second compressor or a second compressor stage of the first precooling compressor to the fourth pressure, merging the compressed mainly liquid second refrigerant stream and the compressed mainly gaseous second refrigerant stream to the second refrigerant stream.

In certain embodiments, compressing the second refrigerant comprises the steps of:

compressing the expanded second refrigerant stream in a first precooling compressor or a first compressor stage of the first precooling compressor to an intermediate pressure yielding a intercooled second refrigerant stream, separating the intercooled second refrigerant stream into a mainly liquid second refrigerant stream and a mainly gaseous second refrigerant stream, wherein the mainly liquid second refrigerant stream is pumped to the fourth pressure, and the mainly gaseous second refrigerant stream is compressed in a second compressor or a second compressor stage of the first precooling compressor to the fourth pressure, merging the compressed mainly liquid second refrigerant stream and the compressed mainly gaseous second refrigerant stream to the second refrigerant stream, guiding the second refrigerant stream and the expanded second refrigerant stream such that heat can indirectly be transferred between the second refrigerant stream and the expanded second refrigerant stream, thereby cooling the second refrigerant stream, separating the cooled second refrigerant stream into a further mainly liquid second refrigerant stream and a further mainly gaseous second refrigerant stream, and separately guiding the further mainly liquid second refrigerant stream and the expanded second refrigerant stream and the further mainly gaseous second refrigerant stream and the second expanded refrigerant stream such that heat can indirectly be transferred between the further mainly liquid second refrigerant stream and the expanded second refrigerant stream and between the further mainly gaseous second refrigerant stream and the expanded second refrigerant stream, thereby further cooling the further mainly liquid second refrigerant stream and the further mainly gaseous second refrigerant stream.

Advantageously, by cooling the second refrigerant stream before separating into a mainly liquid phase and a mainly gaseous phase, and by separately cooling both phases, precooling temperatures around or below 100 K can be achieved without undesired side effect, such as freezing of components of the second refrigerant stream.

In certain embodiments, the further mainly gaseous second refrigerant stream and the further mainly gaseous second refrigerant stream are separately expanded from each other, thereby particularly yielding a first fraction of the expanded second refrigerant stream and a second fraction of the expanded second refrigerant stream.

In certain embodiments, the first fraction of the expanded second refrigerant stream is guided separately from the second fraction of the expanded second refrigerant stream with the feed gas stream, and optionally with the first refrigerant stream, such that heat can indirectly be transferred between the first fraction and the feed gas stream, and optionally the first refrigerant stream, thereby particularly cooling the feed gas stream, and optionally the first refrigerant stream.

In certain embodiments, the first fraction and the second fraction of the expanded second refrigerant are merged to the expanded second refrigerant, particularly after the first fraction has been guided separately from the second fraction with the feed gas stream, and optionally with the first refrigerant stream, wherein particularly after merging the expanded second refrigerant stream is guided with the feed gas stream, and optionally with the first refrigerant stream, such that heat can indirectly be transferred between the expanded second refrigerant stream and the feed gas stream, and optionally the first refrigerant stream, thereby particularly cooling the feed gas stream, and optionally the first refrigerant stream.

In certain embodiments, the expanded second refrigerant stream is compressed in at least three compressor stages or compressors, optionally with intercooling. Alternatively the second refrigerant is compressed in the two phase region in at least three compressor stages or compressor, wherein additionally a pump and a phase separator are arranged between the compressor stages or the compressors, respectively, wherein as described above liquid phases and vapour phases of the third refrigerant stream are separately compressed. Alternatively, all liquid phases are unified and compressed together.

In certain embodiments, the intermediate pressure is in the range of 10 bar(a) and 30 bar(a).

In certain embodiments, the second refrigerant stream is additionally separated into a mainly gaseous phase and a mainly liquid phase, wherein the mainly gaseous phase and the mainly liquid phase are separately expanded, particularly at different temperatures levels, and guided with the feed gas stream. The mainly gaseous phase and the mainly liquid phase may be expanded in separate heat exchangers. In certain embodiments, the mainly gaseous phase and/or the mainly liquid phase are expanded in a throttle valve. In certain embodiments, both vapour and liquid phase are separately guided against the feed gas stream in the precooling zone.

In certain embodiments, the expanded second refrigerant stream and the second refrigerant stream are guided such that heat can indirectly be transferred between the expanded second refrigerant stream and the second refrigerant stream, particularly in the precooling zone, thereby particularly cooling the second refrigerant stream. In certain embodiments, the expanded second refrigerant is guided against the second refrigerant stream such that heat can indirectly be transferred between the expanded second refrigerant stream and the second refrigerant stream, particularly in the precooling zone.

In certain embodiments, the expanded second refrigerant stream and the first refrigerant stream are guided such that heat can indirectly be transferred between the expanded second refrigerant stream and the first refrigerant stream, particularly in the precooling zone, thereby particularly precooling the first refrigerant stream. In certain embodiments, the expanded second refrigerant stream is guided against the first refrigerant stream such that heat can indirectly be transferred between the expanded second refrigerant stream and the first refrigerant stream, particularly in the precooling zone.

In certain embodiments, the feed gas stream is precooled from the initial temperature to a temperature in the range of 278K to 313K in a second precooling step. In certain embodiments, the second precooling step is performed by means of water cooling. In certain embodiments, any one of all of the above-mentioned feed gas stream, first refrigerant stream and second refrigerant stream are additionally precooled before the precooling step by chilled water or cold devices using refrigerants as propane, propylene or carbon dioxide, particularly to temperature in the range of 235 K to 278 K. In certain embodiments, the feed gas stream is provided with a pressure in the range of 15 bar(a) to 75 bar(a). In certain embodiments, the feed gas stream is provided with a pressure in the range of 25 bar(a) to 50 bar(a).

In certain embodiments, the feed gas stream is provided by compressing a feed gas stream comprising hydrogen at ambient temperature to a pressure of at least 15 bar(a), particularly in the range of 15 bar(a) to 75 bar(a), more particular in the range of 25 bar(a) to 60 bar(a), with at least one compressor, wherein the compressor is reciprocating piston compressor with at least one stage, or an ionic liquid piston compressor.

In certain embodiments, the precooled stream is further compressed by cold compression, particularly up to 90 bar, more particularly up 75 bar, even more particularly to a pressure in the range of 25 bar(a) to 60 bar(a). The precooled stream may be compressed in a turbo-expander or in a ionic liquid piston compressor.

In certain embodiments, at least one of the above mentioned turbo-expanders is capable or designed, to generate mechanical or electrical energy upon expansion of said respective streams, e.g. by means of a brake wheel. In a particular embodiment at least one of the turbo-expanders drives: a compressor that compresses the expanded second partial refrigerant stream, and/or a compressor that compresses the partially expanded first refrigerant stream, and/or a compressor that compresses the combined partially expanded partial stream and/or a compressor that compresses the expanded second refrigerant stream. The generated electrical energy may be supplied to the power grid or may be used elsewhere. Likewise, the generated mechanical energy may be used to compress any other of the above-mentioned streams.

In certain embodiments, at least one or all of the above-mentioned heat exchangers are plate-fin heat exchangers, particularly aluminium-brazed plate-fin heat exchangers. In certain embodiments, the precooling heat exchanger is a coil-wound heat exchanger In certain embodiments, the precooling step is performed in a first cold-box and the first cooling step is performed in a second cold-box.

In certain embodiments, the first refrigerant is directly replenished by the feed gas stream, particularly after residual impurities have been removed from the feed gas stream as described above.

BRIEF DESCRIPTION OF THE DRAWINGS

In the following, further features and advantages of the present invention as well as preferred embodiments are described with reference to the Figures, wherein.

DESCRIPTION OF EMBODIMENTS

Figure 1:
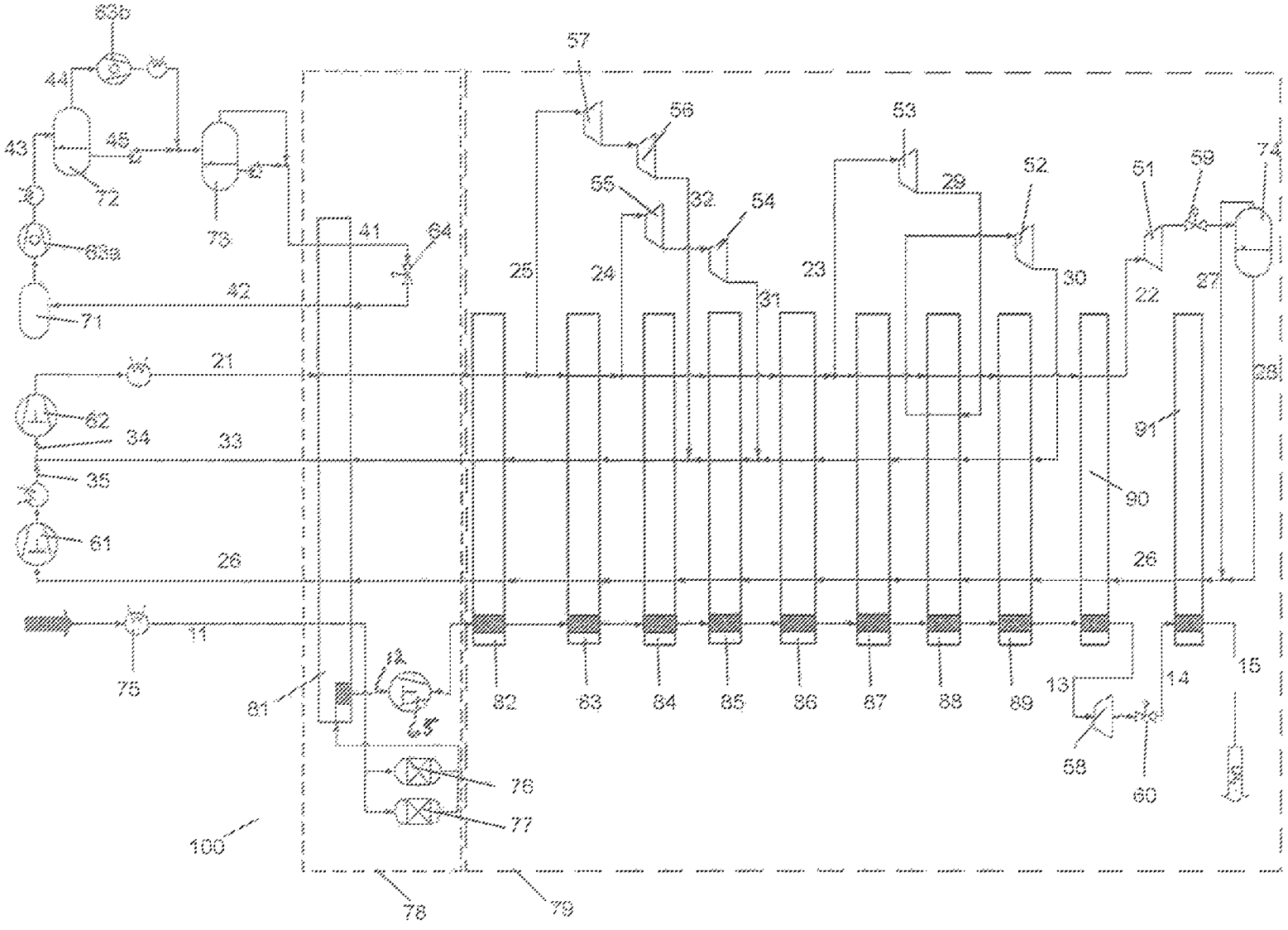
FIG. 1 shows a schematic illustration of a method according to a first embodiment of the invention.

The present invention particularly provides a novel process design for hydrogen liquefaction on a large-scale, combining several process features to a new technically feasible and thermodynamically efficient configuration. The hydrogen feed gas cooling and liquefaction as well as the closed-loop refrigeration cycles can be installed in one or two separate cold-box vessels. Advantageously, the hydrogen feed stream can be directly cooled and liquefied to the state of saturated or even subcooled liquid by the proposed process design, with a final para-hydrogen that can be catalytically converted in the coldest plate-fin heat exchanger to contents above 99.5% para.

Particularly when using two separated cold-boxes (78, 79), a precooling cold-box 78 contains the process equipment for the hydrogen feed gas 11 cooling and part of the single-mixed refrigerant cycle, namely the aluminium-brazed plate-fin heat exchanger 81 and the feed gas purification units 76,77 (adsorber vessels). The feed gas cooling from the lower precooling temperature to liquid hydrogen state is installed in a liquefier cold-box 79.

The precooling duty is provided by a newly designed highly efficient single mixed-refrigerant (MR) cycle. The MR composition in this invention has been optimized for hydrogen precooling to temperatures between 90 K and 120 K, thus differentiating itself from warmer cooling temperature applications as in natural gas liquefaction. In this preferred example the MR mixture precooling is carried out down to a temperature T-PC of about 100 K.

The cooling duty in the liquefier cold-box 79 is provided by a newly designed high pressure process configuration for the hydrogen cold refrigeration cycle. Normal-hydrogen with an approximate 25% para-fraction is preferably used as a refrigerant. Hydrogen with a higher para-fraction may be used as well.

With this new process configuration, the cold-cycle is optimized in pressure level and cold temperature range between the LP (low pressure) streams or partial streams and the MP (medium pressure) stream or partial streams and to allow the implementation of existing process equipment for liquefaction capacities significantly higher than the state-of-the-art. This allows an appropriate shift of the respective refrigerant cooling duty and total mass flow rate of the two cycles, in order to obtain optimal compressor and expander frame-sizes, in terms of energy-efficiency and technical feasibility.

The high pressure hydrogen cold-cycle is new to hydrogen liquefaction as it is specifically designed for large-scale liquefiers, particularly in combination with the Single-Mixed Refrigerant Precooling Cycle at the precooling temperature T-PC, which are significantly lower than in conventionally mixed refrigerant cycles, e.g. 100 K. Particularly, the precooling temperature level in the range 90 to 120 K is higher than in state-of-the art liquefiers e.g. 80 K. Thus, higher cold cycle cooling mass flows are required. This can be balanced by the high-pressure cold-cycle configuration.

Hydrogen Cooling and Liquefaction:

A normal hydrogen (25% para) feed gas stream 11 from a hydrogen production plant is fed to the liquefaction plant 100 with a feed pressure above 15 bar(a), e.g. 25 bar(a), and a feed temperature near ambient temperature, e.g. 303 K. The feed stream 11 with a mass flow rate above 15 tpd, e.g. 100 tpd, is optionally cooled down between 283 K and 308 K, e.g. 298 K, with a cooling water system 75 or air coolers before entering the precooling cold-box 78 through plate-fin heat exchanger 81.

The hydrogen feed 11 is cooled in the aforementioned heat exchanger 81 to the lower precooling temperature T-PC, e.g. 100 K, by the warming-up the low pressure streams of the single mixed-refrigerant cycle 41 and the cold hydrogen refrigeration cycle (26 and 33). At the outlet of the heat exchanger 81, residual impurities are removed from the precooled hydrogen feed gas 12 to achieve a purity of typically 99.99% in the adsorber vessels (also referred to as an adsorption unit) 76, 77 by physisorption. The feed gas 12 enters the adsorption unit 76, 77 at the temperature T-PC, e.g. 100 K, which can thus be designed at about 20 K higher than in prior known hydrogen liquefier applications. This allows the start of the catalytic ortho-para conversion to be shifted to higher temperatures, e.g. 100 K, which is thermodynamically convenient.

Figure 2:
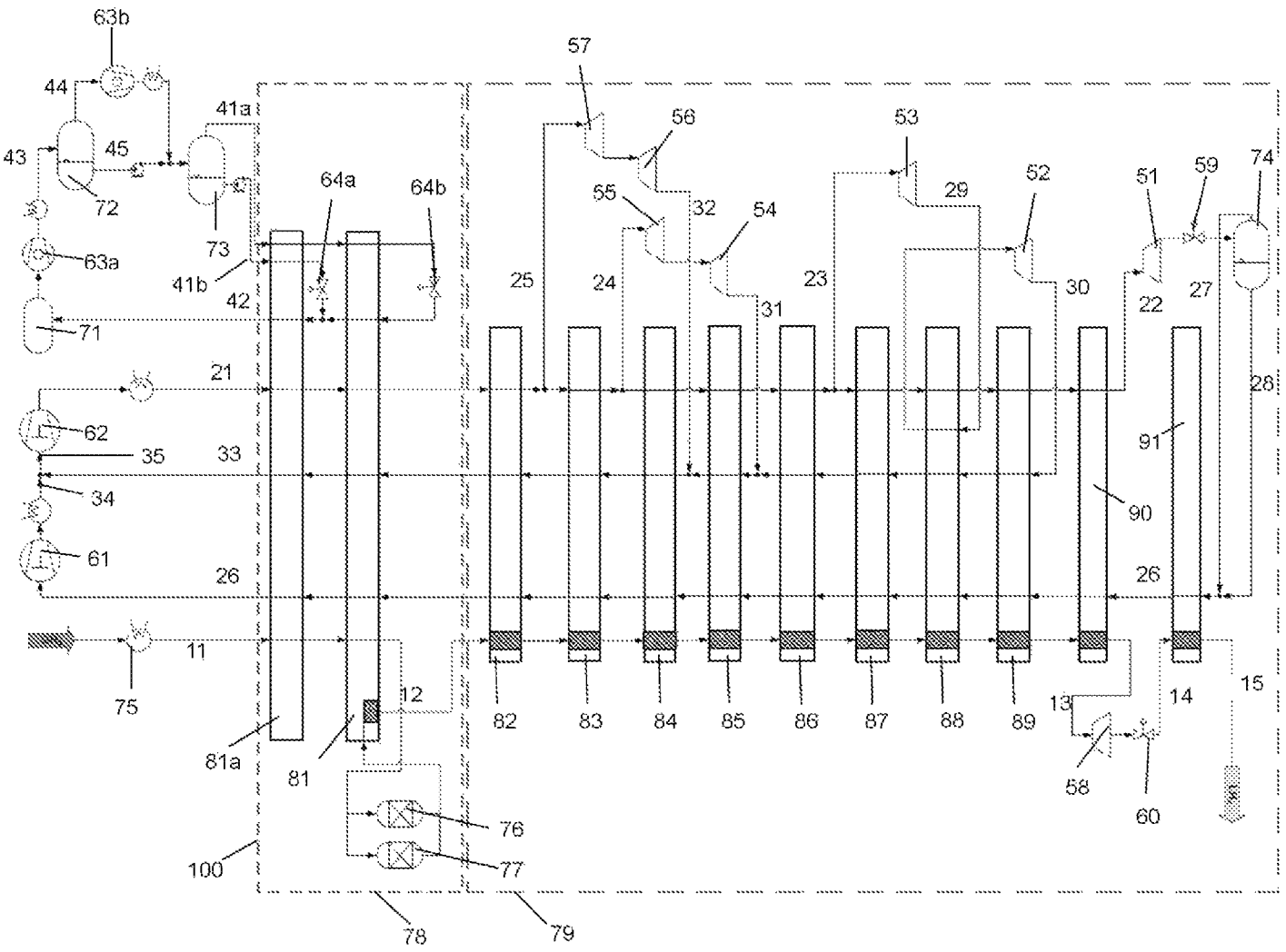
FIG. 2 shows schematic illustration of a method according to another embodiment invention.

After the feed gas purification in the adsorption unit 76, 77, the precooled feed gas stream 12 is routed back to the heat exchanger through 81 the catalyst filled passages (hatched areas in FIG. 1 or 2) of the plate-fin heat exchanger 81, where the normal hydrogen (25% para) is catalytically converted to about 39% para while being cooled to T-PC, while the exothermic heat of conversion is being removed by the warming up refrigerants 42 in the heat exchanger 81.

The precooled feed stream can be further compressed by cold compression, particularly up to 90 bar, more particularly up 75 bar, even more particularly to a pressure in the range of 25 bar(a) to 60 bar(a), in compressor 65. The precooled feed gas stream 12 enters the vacuum-insulated liquefier cold-box 79 with T-PC (between 90 K and 120 K, e.g. 100 K). The precooled feed stream 12 is subsequently cooled and liquefied as well as being catalytically converted to higher hydrogen para-fractions (hatched areas in FIG. 1 or 2) in plate-fin heat exchanger (82 to 90).

The hydrogen gas feed stream 11 from battery-limits may be further compressed e.g. from 25 bar(a) to higher pressures, e.g. 75 bar(a), to increase process efficiency and to reduce volumetric flows and equipment sizes by means of a one or two stage reciprocating piston compressor at ambient temperature, or a one stage reciprocating piston compressor with cold-suction temperatures after precooling in the heat exchanger 81 or an ionic liquid piston compressor.

Alternatively, an adiabatic ortho-para catalytic converter vessel may be used in the precooling cold box 78 to pre-convert normal-hydrogen (25%) para to a para-fraction near equilibrium in the feed gas stream 12 at the outlet of adsorber vessels 76, 77, before routing the feed gas stream 12 back to the heat exchanger 81.

Detailed Description of the Single Mixed-Refrigerant Precooling Cold Cycle

A low pressure mixed refrigerant stream 42 is routed through suction drum 71 to avoid that entrained liquid droplets from the warmed-up refrigerant stream arrive to the suction side of compressor of stage one 63*a* of the compressor 63. The MR composition and the discharge pressure of the resulting refrigerant stream 43 (particularly in the range of 10 bar(a) to 25 bar(a)), after at least one compression stage, are optimized to produce the aforementioned stream 43 with a liquid fraction after intercooling. This reduces the mass-flow of refrigerant 43 that has to be compressed in stage two 63*b* of the compressor 63. The intercooled refrigerant stream 43 is separated into a liquid mixed refrigerant stream 45 that is pumped to the high pressure (particularly in the range of 30 bar(a) and 70 bar(a)) and into a vapour refrigerant stream 44, which is compressed to high pressure (particularly in the range of 25 bar(a) and 60 bar(a)) by the second stage 63*b* of compressor 63. Both the vapour 44 and the liquid stream 45 are mixed to form a two-phase high pressure mixed-refrigerant stream 41 after compression in the compressor 63. The first vapour stream 44 may be additionally separated into a second liquid phase and a second vapour phase, wherein preferably the first liquid phase 45 and the second liquid phase are unified, pumped together to high pressure and afterwards unified with the second vapour phase before entering the precooling cold box 78. Alternatively, the low pressure mixed refrigerant stream may be compressed by more than two stages. If compression and after-cooling results in the formation of a liquid phase, additional phase separators may be arranged between the compressor stages.

The two-phase high pressure mixed-refrigerant stream 41 enters the precooling cold-box 78 passing through the heat exchanger 81, where it is precooled to the lower precooling temperature of 100 K. A Joule-Thomson valve 64 expands the precooled mixed-refrigerant stream 41 to form an expanded mixed refrigerant stream 42 that is characterized by an optimized low pressure level, particularly between 1.5 bar(a) and 8 bar(a). The refrigerant mixture of the high pressure mixed refrigerant stream 41 is designed to cool down from the temperature T-PC by at least 2.5 K, e.g. 96 K, through the Joule-Thomson expansion. The mixture temperature decrease is designed to maintain a feasible temperature difference between warming up and cooling down streams in the heat exchanger 81 as well as to assure that no component freeze-out occurs in the refrigerant mixture.

Additionally, the two-phase high pressure mixed-refrigerant stream 41 may be further separated into a vapour 41*a* and a liquid phase 41*b*, wherein the liquid phase 41*b* may be additionally pumped to a high pressure and then unified with the vapour phase 41*b* before entering the precooling cold box 78. Alternatively, the vapour stream 41*a* of the above mentioned additional separation is guided through the heat exchanger 81 and an additional heat exchanger 81*a* or through two separate blocks 81, 81*a* of heat exchanger 81 in the precooling cold-box 78, expanded in a throttle valve 64*b* and guided again through both exchangers or blocks 81, 81*a*, whereby the liquid stream 41*b* of the additional separation is guided through the additional heat exchanger 81*a*, expanded in a throttle valve 64*a* and guided again through the additional exchanger 81*a*.

Figure 3:
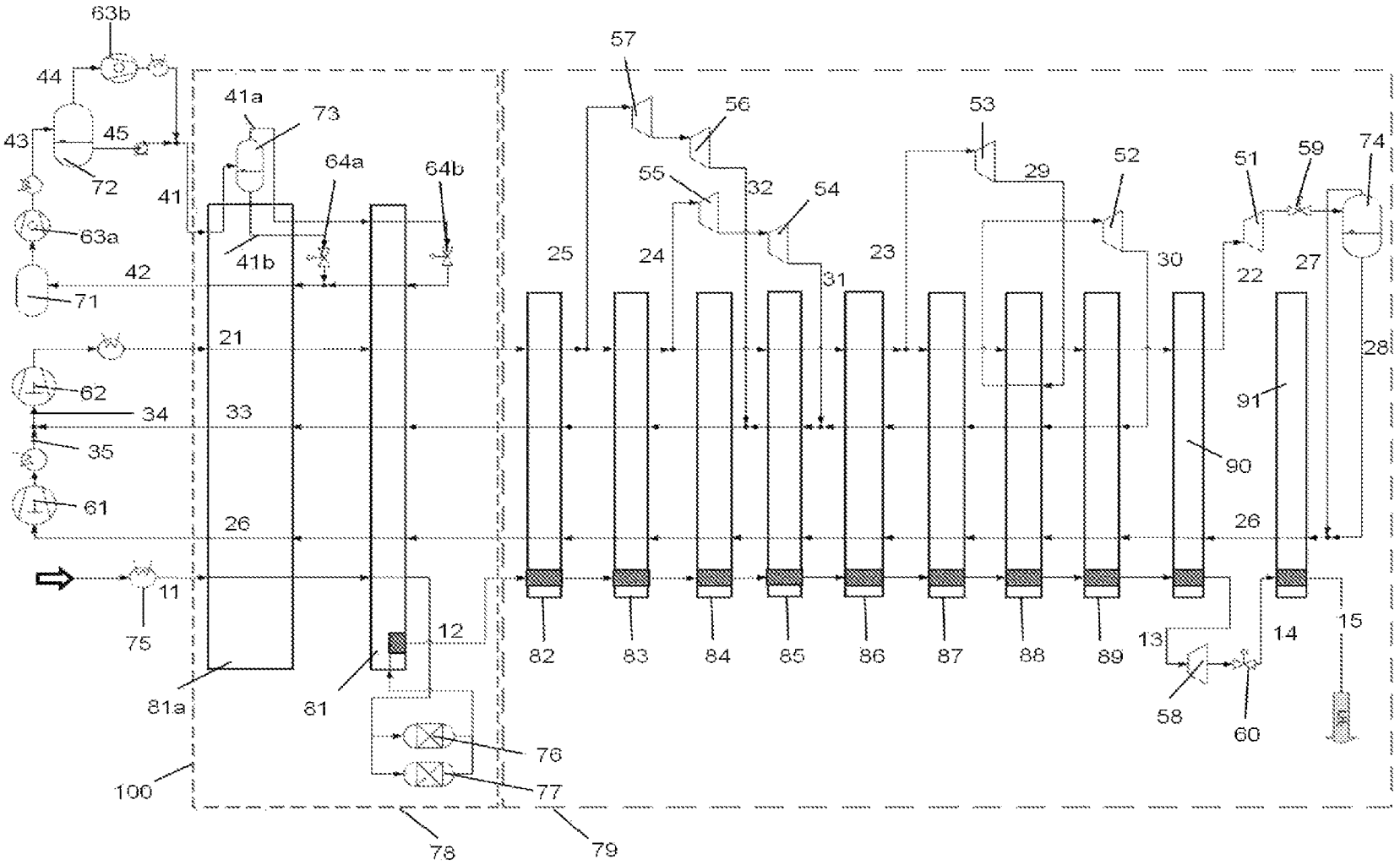
FIG. 3 shows a schematic illustration of a method according to a further embodiment of the invention.

Also alternatively as depicted in FIG. 3, the two-phase high pressure mixed-refrigerant stream 41 may be guided through the additional heat exchanger 81*a*, and thereby cooled, and separated into a vapour 41*a* and a liquid phase 41*b* in a phase separator 73. The vapour stream 41*a* of the above mentioned additional separation is then guided through the heat exchanger 81 and an additional heat exchanger 81*a* or through two separate blocks 81, 81*a* of heat exchanger 81 in the precooling cold-box 78, expanded in a throttle valve 64*b* and guided again through both exchangers or blocks 81, 81*a*, wherein the liquid stream 41*b* of the additional separation is guided through the additional heat exchanger 81*a*, expanded in a throttle valve 64*a* and guided again through the additional exchanger 81*a*.

Particularly, the vapour stream 41*a* may be merged after passing the heat exchanger 81 and expansion in the throttle valve 64*b* with the liquid stream 41*b* after passing the additional heat exchanger 81*a* and expansion in the throttle valve 64*a*, wherein the so merged expanded mixed-refrigerant stream is then guided through the additional heat exchanger 81*a*.

The MR composition can be regulated and controlled by the make-up system to adapt the mixture composition to ambient conditions and changed process conditions. The mixed-refrigerant is compressed in a two-stage MR turbo-compressor with interstage water cooling to decrease power requirement.

Alternatively, in a very simplified configuration, the low pressure refrigerant stream 42 can be compressed within an at least two-stage compressor 63 with inter-stage cooling, and the refrigerant composition can be designed to avoid the appearance of a liquid fraction after the first compression stage 63*a*. Advantageously, no liquid pumps and no phase separator are required. However, a lower efficiency is expected.

Low temperature precooling is efficiently achieved with a refrigerant mixture optimized specifically for hydrogen liquefaction, wherein the refrigerant preferably contains only four refrigerant components to maintain a manageable plant makeup system. A preferred mixture composition for a precooling temperature in the range of 90 K to 100 K consists of 18 mol. % nitrogen, 27 mol. % methane, 37 mol. % ethane and 18 mol. % isopentane. Ethylene may replace the ethane component for reasons of refrigerant availability and cost. For precooling temperatures between 90 K and 100 K, iso-butane may be replaced by 1-butene, iso-pentane, propane or propylene The mixture of the mixed-refrigerant may be adapted depending on the precooling temperatures. Accordingly, the mixture may contain nitrogen, methane, ethylene, and n-butane, isobutane, propane, propylene iso-pentane, iso-butane and/or n-pentane for precooling temperatures between 100 K and 120 K (or higher).

For precooling temperatures above 85 K, the mixture may contain nitrogen, argon, neon, methane, ethane, propane, propylene, 1-butene.

Also alternatively, the hydrogen feed stream 11 may be precooled to temperatures above 120 K, wherein in this case the mixed-refrigerant preferably contains nitrogen, methane, ethylene, n-butane.

For slightly higher process efficiencies, a fifth or more refrigerant mixture component(s) can be added to the refrigerant mixture: iso-butane, iso-pentane, 1-butane, argon, neon, propane or propylene for precooling temperatures between 90 K and 100 K, or n-butane, iso-butane, iso-pentane, propane, propylene or pentane for the precooling temperature T-PC, particularly above 100 K, and additionally n-pentane, for precooling temperatures above 110 K.

Additionally, conventional refrigeration units (chiller), e.g. vapour compression refrigerators, operated with e.g. propane, propylene or CO2, can be placed to cool down the high pressure lines 11, 21, 41 from ambient temperature, downstream the respective water coolers 75, to increase the overall energy-efficiency of the plant. Chiller(s) can be placed in the Single Mixed-Refrigerant stream 41 and/or the Hydrogen Cold Refrigeration cycle stream 21 and/or the Feed Hydrogen stream 11.

Alternatively or additionally, a liquid nitrogen (LIN) stream at e.g. 78 K, or liquid natural gas (LNG) at e.g. 120 K, can be evaporated in the heat exchanger 81 against the high pressure cooling down streams 21, 31 to provide additional cooling duty to precool the high pressure cooling down streams. The LIN stream, for instance, can reduce the cooling duty, and thus the refrigerant mass flows, to be provided by both the SMR cycle and the HP Hydrogen cycle.

Detailed Description of the Main Cooling High Pressure-Hydrogen Cycle

The high pressure hydrogen stream 21 with a pressure of at least 25 bar(a), particularly 30 bar(a) to 70 bar(a) enters the precooling cold-box 78 and is precooled by the warming up streams 42, 33, 26 in the heat exchanger 81 to the precooling temperature T-PC. At the inlet of the liquefier cold-box 79, this stream 21 is further precooled by the warming up streams of the cold hydrogen refrigeration cycle (33 and 26). The high pressure stream 21 is then separated in to four partial streams 22, 23, 24, 25 at different temperature levels, to generate cooling by nearly isentropic expansions (polytropic) in min. five turbine-expanders. In the illustrated example, seven turbine-expanders are employed (51 to 57) providing in total four turbine strings for the four partial streams 22, 23, 24, 25. The turbines 51 to 57 within the high-pressure process are designed with rotational speeds and frame-sizes that are industrially feasible and allow the partial recovery of process energy e.g. by the means of turbine brakes coupled with a turbo-generator to produce electricity and thus increase the total plant energy-efficiency. Alternatively, each of the above mentioned turbine strings may comprise only one turbo-expander, respectively, wherein the each partial stream is directly expanded in a single turbo-expander to a low or a medium pressure.

In the preferred invention example, the high pressure hydrogen flow 21 is first separated after being cooled in a heat exchanger 82. One fraction, or partial stream (also referred to as a fourth partial stream) 25 is routed to a first turbine string (57 and 56), in which it is expanded in two-stages from high pressure to a medium pressure to form a medium pressure (fourth partial) stream 32, particularly in the range 6 bar(a) to 12.9 bar (a), more particularly in the range of 7 bar (a) to 11 bar(a), e.g. 9 bar(a), to achieve high isentropic efficiencies with moderate turbine rotational speeds. This medium pressure stream 32 provides cooling duty to the cooling down streams 12, 21.

The remaining high pressure flow fraction is subsequently cooled in heat exchanger 83 to the temperature of a second turbine string 24. A further partial stream (also referred to as a third partial stream) 24 is then separated and expanded in two-stages (55 and 54) to the above-mentioned medium pressure level to form a partially expanded stream 31. This partially expanded (third partial) stream 31 is warmed up and mixed with the above-mentioned medium pressure stream 32 in order to provide additional cooling to duty to the cooling down streams 12, 21. The turbine strings for the streams 25 and 24 can, alternatively, be designed with intermediate cooling between the two expansion stages.

A further remaining high pressure flow fraction, or partial stream (also referred to as the first partial stream) 23 routed to a third turbine string after being further cooled down by the warming up streams in heat exchanger(s) 85, 86. The following process feature is special to this hydrogen liquefaction process: the first partial stream 23 is expanded in turbo-expander 53 to an intermediate pressure between medium pressure and high pressure, to produce an intermediate pressure stream 29. The resulting intermediate pressure stream 29 preferably has a temperature above the critical temperature of the refrigerant, e.g. 34 K to 42 K. The intermediate pressure stream 29 is then re-warmed slightly in a further heat exchanger 88 before being expanded again in turbo-expander 52 to the medium pressure level yielding a medium pressure (first partial) stream 30. In this way, cooling with the third turbine string is generated at two different pressures (medium and intermediate pressure) and two different temperature levels. The heat exchanger enthalpy-temperature curve between the cooling down and warming up streams in a critical temperature range, e.g. 30 K to 50 K, can, hence, be matched more closely. This can reduce exergetical losses in the heat exchanger. This new process configuration is particularly beneficial for hydrogen feed cooling since: depending on the pressure, the specific isobaric heat capacity of the hydrogen feed stream possesses steep gradients in the region close to its critical temperature (particularly between 30 K and 50 K). Alternatively in an embodiment not shown, the third turbine string for the first partial stream 23 can be designed analogous to first and second turbine strings 25 and 24, with no intermediate warming-up after the first turbine, or with a slight cooling down between the expanders.

The medium pressure stream 30 provides cooling duty to the cooling down streams in the heat exchangers 86 to 89 up to the temperature of turbine outlet 54, where it is mixed with the medium pressure stream 31. The mixed stream is warmed approximately to the temperature of the turbine 56 outlet (between the precooling temperature and the temperature of cooled feed stream 13 at the cold end of the heat exchanger 89, where it is further mixed with the medium pressure stream 32. The total medium pressure hydrogen flow 33 is warmed up in the heat exchangers 84 to 81 to a temperature close to ambient temperature, thereby providing additional cooling duty to the cooling down streams 11, 21, 41.

The outlet temperature and pressure of turbo-expander 52 are optimized in combination with the cold-end hydrogen cycle. The temperature of the medium pressure stream 30 at the turbine outlet is the cold-end temperature T-CE. For the newly proposed high pressure cycle, optimal cold-end temperatures T-CE for the high pressure cycle are set between 28 K and 33 K, particularly between 29 K and 32 K, for a dry-gas turbine discharge and an optimal MP1 pressure level, particularly in the range of 6 bar(a) and 12.9 bar(a), more particularly between 7 bar(a) and 11 bar(a), at the outlet of the turbo-expander 52 (medium pressure level between 7 bar(a) and 11 bar(a)). The warmed-up stream 33 is mixed with the compressed low pressure stream 26 from the compressor 61 to produce a mixed stream 34. The mixed stream 34 is compressed from medium pressure level in e.g. one or preferably two parallel running 100% reciprocating piston compressors 62, or alternatively three parallel running 50% reciprocating piston compressors to the high pressure level between 30 bar(a) and 75 bar(a). Temperature T-CE, medium and high pressure levels are optimized in function of precooling temperature TPC and liquid hydrogen production rate (feed mass flow rate). Piston compressors 61 and 62 are designed with at least two intercooled stages each (three stages preferred). Alternatively, at least one 100% multi-stage turbo-compressor can be installed in the line of the mixed stream 34 for compression from medium pressure to an intermediate pressure. This has the advantage to reduce the volumetric flow before the MP to HP compression for very large liquefaction capacities or directly for MP to HP compression (high compressor blade tip speeds required). Alternatively, for cold-compression (range 80 K to 150 K), a 100% hydrogen turbo-compressor is used for MP to HP compression.

Compared to prior known technology, this high pressure configuration with significantly higher turbine outlet pressure levels (medium and high) yields moderate effective volumetric flows at the suction of compressor 62, thus enabling the design of mechanically viable frame-sizes for the hydrogen piston compressor, even for very large liquefaction capacities e.g. up to 150 tpd (with two parallel compressors).

Alternatively or additionally, a hydrogen high-speed turbo-compressor is installed in the line before the reciprocating compressor 62.

At the cold end, the remaining high pressure hydrogen flow fraction, or partial stream (also referred to as the second partial stream) 22 in the cold-cycle provides the cooling for the final liquefaction and ortho-para conversion of the feed stream 12, 13, 14. The high pressure hydrogen refrigerant 22 is expanded from high pressure to low pressure in at least one turbine string through at least one turbo-expander e.g. 51.

If the turbo-expander 51 is to be designed with a dry-gas discharge, high pressure stream 22 is expanded from high pressure to an intermediate pressure, above the critical pressure, e.g. 13 bara, or to a pressure below, e.g. in the range of 5 bar(a) to 13 bar(a), if no two-phase is to be generated within the turbine 51 or at the outlet of the turbine 51. Subsequently, the cooled stream is expanded through a Joule-Thomson throttle valve 59 into a gas-liquid separator 74. For a turbo-expander with allowed two-phase discharge, e.g. a wet expander, the high pressure stream 22 can be expanded directly to low pressure level. Alternatively, a cold liquid piston expander can be employed to expand the high pressure stream 22 directly to low pressure level into the two-phase region. In either case, the low pressure level is fixed to provide a cooling temperature of stream 26 below the feed temperature for saturated liquid (between 20 K and 24 K). The low pressure stream 26 stream is warmed-up to near ambient temperature providing cooling duty to the cooling down streams 11, 12, 21, 41 in the precooling and liquefier cold-box. The low pressure stream 26 is then compressed in one multistage reciprocating piston compressor 61 with interstage cooling.

Alternatively, the warming up low pressure stream 26 may be compressed at cold suction temperatures instead at near ambient temperature. The low pressure hydrogen stream 26 is warmed up to a cold compressor suction temperature level of e.g. 100 K. This cold stream 26 is then compressed by the means of a cold reciprocating compressor. Compressor frame-size and number of stages of compressor 61 are significantly reduced. The cold compressor can be designed without gas intercoolers and aftercoolers, further reducing equipment capital cost. The medium pressure hydrogen stream 33 is warmed up in the heat exchanger 81 close to compressor 61 discharge temperature. The medium pressure stream 33 is compressed in a cold turbo-compressor or reciprocating compressor instead that at near ambient temperature. Feasible turbo-compressor stage pressure ratio is increased and volumetric flow at suction is significantly decreased at decreased suction temperature. The required number of compressor stages and the machine frame-size (investment costs) are reduced significantly.

Alternatively, the reciprocating piston compressor 61 and 62 can be installed in one-casing in a multi-service reciprocating compressor machine.

The hydrogen feed stream 12 is cooled by the warming up cold low pressure stream 26 down to a temperature equal to the high pressure stream 22, e.g. 29.5 K, and is catalytically converted to a para-fraction slightly below the equilibrium para-fraction. The cooled feed stream 13 is then expanded by the means of at least one turbo-expander 58 from feed pressure to an intermediate pressure e.g. 13 bar(a) or lower. Subsequently, the expanded and cooled feed stream is further expanded through the Joule-Thomson throttle valve 60 to the low pressure level that is required for final product storage pressure e.g. 2 bar(a) and particularly further cooled by the low pressure stream 26.

For turbo-expanders allowing a two-phase discharge, the high pressure feed stream 13 can be directly expanded into the two-phase region to the product storage pressure e.g. 2 bar(a). For shaft power around 50 kW or above, as in large-scale liquefiers with e.g. 100 tpd capacity, a turbo-expander with energy-recovery via a turbo-generator can be employed to raise the plant energy-efficiency. Alternatively, a cold liquid piston expander can be employed to directly expand the feed stream from the intermediate pressure level, e.g. 13 bar(a), to the low pressure level near the final product storage pressure. In either case, the two-phase hydrogen feed stream 14 is finally cooled and can be further catalytically converted in the last part of plate-fin heat exchanger 91 with the aid of the warming-up low pressure cold-cycle refrigerant stream 26.

With this configuration, a liquid hydrogen product stream 15 at the outlet can be generated as saturated liquid or even subcooled liquid. A final para-fraction of the liquid product stream 15 above 99.5% can be reached if desired.

The method of the invention offers the following advantages:

In summary:

- Significant decrease in specific energy demand and specific costs for the production of liquid hydrogen on a large-scale compared to prior known technologies;
- New process configuration combining a highly efficient Single-Mixed Refrigerant precooling cycle (precooling cold-box 78) to an optimized High-Pressure Hydrogen Claude-Cycle (liquefier cold-box 79) for large-scale hydrogen liquefaction;
- The new configuration combining Single-Mixed-Refrigerant technology with a High-Pressure Hydrogen Claude-Cycle reduces the total rotating equipment count of the liquefier plant compared to known concepts for large-scale hydrogen liquefaction. The resulting moderate hydrogen refrigerant volumetric flows, even at high hydrogen liquefaction capacities, enable the use of only three highly-efficient reciprocating piston compressor machines, which are based on available compression technology. The HP Hydrogen Cycle design avoids the use of more than two very large piston compressors running in parallel (high maintenance/downtimes) or the design of not yet available hydrogen compressor technologies e.g. very high-speed hydrogen turbo-compressors at ambient temperature.
- New refrigerant mixture for hydrogen liquefaction enabling precooling temperatures T-PC between 90 K and 120 K e.g. 100 K, which are significantly lower than in conventional mixed-refrigerant technology applications.

Temperature decrease from T-PC across Joule-Thomson expansion valve is designed to maintain safety margin to the mixture melting point to avoid component freeze out.

- The low precooling temperature for the mixed-refrigerant combines the benefits of a high energy-efficient single mixed-refrigerant cycle with comparatively low precooling temperatures. This is beneficial because of the decreased cooling duty to be provided by the cold-cycle, thus reducing equipment size in the colder refrigeration cycle e.g. size of heat exchanger, compressor and turbine. The size of the most critical part of the plant in respect to space requirements, the liquefier cold-box, can also be reduced.
- HP Hydrogen Cycle configuration providing cooling at different temperature levels:
  - Hydrogen refrigeration cycle with at least two turbine strings for the HP-MP level and at least one turbine string for the HP-LP level.
  - New turbine configuration for turbine string 53 and 52 to provide additional cooling duty at two different pressure levels (MP1 and MP2) to match closely the temperature-enthalpy curve of the hydrogen feed stream between, particularly between 30 K and 50 K. This is important especially for the sharp increase in specific isobaric heat of capacity of the hydrogen feed stream around the critical temperature of hydrogen.
  - For the pressure ratios and volumetric gas flows required by conventional refrigeration cycles for large-scale hydrogen liquefaction, turbo-compressors for ambient temperature suction for 100 mol. % helium and 100 mol. % hydrogen refrigerants would require complex designs with impracticable high number of compression stages per machine or very high wheel tip speeds and thus rotational speeds that are currently not feasible.
  - Screw compressors for helium or hydrogen have a low isentropic efficiency. Reciprocating compressors are limited in frame-size principally by the maximum practicable volumetric suction flow rates. Prior known designs for hydrogen reciprocating compressors for large-scale hydrogen liquefiers with e.g. up to 150 liquefaction capacity, would require three or more very large reciprocating piston compressors with among the largest available frame-sizes, and thus footprint, to operate in parallel e.g. 3×100% or 4×100%. This would be an unfavourable design in terms of investment costs, plant maintainability, reliability and availability. Industrial gas plants with reciprocating compressors that require favourable turndown capabilities as well as economically feasible investment and operating costs (plant availability), are typically designed with reciprocating compressors in a 2×100% configuration.

Hydrogen cycle HP-MP and HP-LP pressure and temperature levels in this new configuration are optimized for the design of mechanically feasible and highly-efficient compressor frame-sizes for hydrogen. In this way, hydrogen compressor 62 can be designed with two parallel running highly-efficient reciprocating compressors, 2×100%, even for liquefaction capacities in the range of ten to thirty times the current largest plants e.g. 150 tpd.

HP level of the hydrogen refrigeration cycle effectively reduces the frame-size of hydrogen turbo-expanders 51 to 56. This enables the implementation of available and highly-efficient hydrogen high-speed turbo-expanders even for liquefaction capacities >50 tpd e.g. turbines with gas bearings.

The low melting point of normal-hydrogen refrigerant (14 K) allows the cooling down and liquefaction of the feed stream. Compared to prior known technologies for large-scale liquefaction, adopting neon or neon-mixtures as sole cold-cycle refrigerant, parafractions above 99.5% and a subcooling of the liquid hydrogen feed stream can be reached.

A cold-cycle compression for compressor(s) 61 and 62 can be performed at cryogenic suction temperatures alternatively to the state-of-the-art warm suction compression. This configuration would further reduce hydrogen compressor frame sizes and number of required stages.

Compared to neon and helium, the cost of hydrogen refrigerant is currently significantly lower than the cost of neon or helium refrigerants. For hydrogen liquefaction, a higher thermodynamic efficiency can typically be achieved by pure hydrogen or hydrogen-rich cycles compared to refrigeration cycles based on 100 mol. % neon or 100% mol. helium refrigerant, Innovative possibility to apply new highly efficient ionic compression technology to hydrogen liquefaction e.g. for hydrogen feed compressor, alternatively to state-of-the-art hydrogen piston compressors.

Start of the continuous catalytic ortho-para conversion in plate-fin heat exchanger, e.g. directly after the MR precooling, is designed at a higher temperature level, e.g. 100 K, compared to prior known technology. (80 K) Due to the removal of exothermic heat of conversion at a higher temperature level, the thermodynamic efficiency of the plant is improved. This can be realized by installing an adsorption unit at 100 K or higher. The adsorption vessel (physisorption) removes residual impurities from the hydrogen feed which can poison the catalyst and block the feed stream.

REFERENCE NUMERALS

| | |
|---|---|
| 100 | hydrogen liquefaction plant |
| 11 | hydrogen feed stream (25 bar(a), ambient temperature) |
| 12 | precooled hydrogen feed stream (100 K, 25 bar(a)) |
| 13 | cooled hydrogen feed stream (27 K to 35 K) |
| 14 | expanded cooled hydrogen feed stream (2 bar(a)) |
| 15 | Liquid hydrogen product stream |
| 21 | high pressure stream |

-continued

| | |
|---|---|
| 22 | high pressure second partial stream |
| 23 | high pressure first partial stream |
| 24 | high pressure third partial stream |
| 25 | high pressure fourth partial stream |
| 26 | low pressure second partial stream |
| 27 | vapour phase of low pressure first partial stream |
| 28 | liquid phase of low pressure first partial stream |
| 29 | intermediate pressure first partial stream |
| 30 | medium pressure first partial stream |
| 31 | medium pressure third partial stream |
| 32 | medium pressure fourth partial stream |
| 33 | combined medium pressure stream |
| 34 | further combined medium pressure stream |
| 35 | medium pressure second partial stream |
| 41 | high pressure mixed refrigerant stream |
| 41a | vapour phase of high pressure mixed refrigerant stream |
| 41b | Liquid phase of high pressure mixed refrigerant stream |
| 42 | low pressure mixed refrigerant stream |
| 43 | medium pressure mixed refrigerant stream |
| 44 | vapour phase of medium pressure mixed refrigerant stream |
| 45 | liquid phase of medium pressure mixed refrigerant stream |
| 51, 52, 53, 54, 55, 56, 57, 58 | turbo-expander |
| 59, 60, 64, 64a, 64b | throttle valve |
| 61 | piston compressor |
| 62 | piston compressor |
| 63a | first compressor stage |
| 63b | second compressor stage |
| 71 | suction drum |
| 72, 73, 74 | phase separator |
| 75 | water cooling |
| 76, 77 | adsorber vessel |
| 78 | pre cooling cold box |
| 79 | liquefier cold box |
| 81, 82, 83, 84, 85, 86, 87, 88, 89, 90, 91 | heat exchanger block or heat exchanger filled with ortho-para catalyst (hatched area) |

The invention claimed is:

1. A method for liquefying hydrogen, the method comprising:

providing a feed gas stream comprising hydrogen, wherein said feed gas stream has a pressure of at least 15 bar(a) and an initial temperature, precooling said feed gas stream from said initial temperature to an intermediate temperature to yield a precooled feed gas stream, wherein said intermediate temperature is in the range of 85 K to 120 K, cooling said precooled feed gas stream from said intermediate temperature to a temperature below the critical temperature of hydrogen yielding a liquid product stream comprising hydrogen;

wherein said precooled feed gas stream is cooled by a closed cooling cycle with a first refrigerant stream comprising hydrogen wherein said cooling cycle comprises:

providing said first refrigerant stream with a first pressure, wherein said first pressure is at least 25 bar(a), separating said first refrigerant stream at least into a first partial stream and a second partial stream, expanding said first partial stream in a first expansion device to a second pressure yielding a partially expanded first partial stream, wherein said second pressure is at least 6 bar(a), guiding said partially expanded first partial stream and said second partial stream such that heat can indirectly be transferred between said partially expanded first partial stream and said second partial stream, expanding said second partial stream in a second expansion device to a third pressure yielding an expanded second partial stream, wherein said third pressure is below said second pressure, guiding said expanded second partial stream and said precooled feed gas stream such that heat can indirectly be transferred between said expanded second partial stream and said precooled feed gas stream, compressing said expanded second partial stream from said third pressure to a pressure that differs from said second pressure by not more the 10% yielding a partially expanded second partial stream, merging said partially expanded first partial stream and said partially expanded second partial stream to form a partially expanded first refrigerant stream, and compressing said partially expanded first refrigerant stream to said first pressure yielding said first refrigerant stream; and wherein said feed gas stream is precooled in said precooling by a closed precooling cycle with a second refrigerant stream, wherein said second refrigerant comprises a mixture of $C_1$-$C_5$ hydrocarbons or a mixture of nitrogen and $C_1$-$C_5$ hydrocarbons, wherein said precooling comprises:

providing said second refrigerant with a fourth pressure, expanding said second refrigerant stream in an additional expansion device to a fifth pressure yielding an expanded second refrigerant stream, guiding said expanded second refrigerant stream and said feed gas stream such that heat can indirectly be transferred between the expanded second refrigerant stream and said feed gas stream, thereby cooling said feed gas stream to said intermediate temperature, and compressing said expanded second refrigerant stream to said fourth pressure in a first precooling compressor yielding said second refrigerant stream.

2. The method according to claim 1, wherein said first refrigerant stream is further separated at least into a third partial stream, and optionally a fourth partial stream, wherein said third partial stream is expanded in a third expansion device yielding a partially expanded third partial stream, and, if present, said fourth partial stream is expanded in a fourth expansion device, yielding a partially expanded fourth partial stream, said partially expanded third partial stream and said partially expanded first partial stream, and, if present, said expanded fourth partial stream, are merged to form a combined partially expanded partial stream, and said combined partially expanded partial stream and said partially expanded second partial stream are merged to form said partially expanded first refrigerant stream.

3. The method according to claim 1, wherein said first partial stream is expanded in said first expansion device to a first intermediate pressure yielding an intermediate first partial stream, said intermediate first partial stream is expanded in said first expansion device to said partially expanded first partial stream, and, prior to expansion of said intermediate first partial stream in said first expansion device, said intermediate first partial stream and said second partial stream are guided such that heat can indirectly be transferred between said intermediate first partial stream and said second partial stream.

4. The method according to claim 1, wherein said second refrigerant stream comprises four components, wherein a first component is nitrogen, a second component is methane, a third component is ethane or ethylene, and a fourth component is n-butane, isobutane, propane, propylene, n-pentane or isopentane.

5. The method according to claim 1, wherein said precooled feed gas stream is brought into contact with a catalyst being able to catalyze conversion of ortho hydrogen to para hydrogen.

6. The method according to claim 5, wherein residual impurities are removed from said precooled feed gas stream before contacting said catalyst.

7. The method according to claim 1, wherein compressing said expanded second refrigerant stream comprises:

compressing said expanded second refrigerant stream in said first precooling compressor or a first compressor stage of said first precooling compressor to yield compressed second refrigerant stream at an intermediate pressure, and subjecting the compressed second refrigerant stream to intercooling to yield an intercooled second refrigerant stream, separating said intercooled second refrigerant stream into a mainly liquid second refrigerant stream and a mainly gaseous second refrigerant stream, wherein said mainly liquid second refrigerant stream is pumped to said fourth pressure, and said mainly gaseous second refrigerant stream is compressed in a second precooling compressor or a second compressor stage of said first precooling compressor to said fourth pressure, and merging said compressed mainly liquid second refrigerant and said compressed mainly gaseous second refrigerant to form said second refrigerant stream.

8. The method according to claim 7, wherein said second refrigerant stream is additionally separated into a mainly gaseous phase and a mainly liquid phase, wherein said mainly gaseous phase and said mainly liquid phase are separately expanded, and said expanded phases and said feed gas stream are separately guided such that heat can indirectly be transferred between said expanded phases and said feed gas stream.

9. The method according to claim 1, wherein said cooled feed gas stream is expanded in a further expansion device to a storage pressure and thereby further cooled.

10. The method according to claim 9, wherein said at least one turbo-expander is designed to generate mechanical or electrical energy upon expansions of the streams expanded by the respective turbo-expander.

11. The method according to claim 1, wherein said precooled feed gas stream is further compressed to a pressure above 15 bar(a).

12. The method according to claim 1, wherein said precooled feed gas stream is cooled from said intermediate temperature to a temperature below 24 K to yield said liquid product stream comprising hydrogen.

13. The method according to claim 1, wherein in guiding said expanded second partial stream and said precooled feed gas stream such that heat can indirectly be transferred between said expanded second partial stream and said precooled feed gas stream, aid precooled feed gas stream is cooled to a temperature below the critical temperature of hydrogen.

14. The method according to claim 2, wherein said cooled feed gas stream is expanded in a further expansion device to a storage pressure and thereby further cooled.

15. The method according to claim 14, wherein at least one or all of said first expansion device, said second expansion device, said third expansion device, said fourth expansion device, and said further expansion device comprise at least one turbo-expander.

16. The method according to claim 1, wherein said second refrigerant stream consists of four components, wherein a first component is nitrogen, a second component is methane, a third component is ethane or ethylene, and a fourth component is n-butane, isobutane, propane, propylene, n-pentane or isopentane.

17. The method according to claim 1, wherein said intermediate temperature is in the range of 85 K to 110 K.

18. The method according to claim 5, wherein residual impurities are removed from said precooled feed gas stream by means of an adsorber before contacting said catalyst.

19. The method according to claim 9, wherein said storage pressure is in the range of 1.0 bar(a) to 3.5 bar(a).

20. The method according to claim 9, wherein said storage pressure is in the range of 1.0 bar(a) to 2.5 bar(a).

21. The method according to claim 11, wherein said precooled feed gas stream is further compressed to a pressure up to 90 bar(a).

22. The method according to claim 11, wherein said precooled feed gas stream is further compressed to a pressure between 25 bar(a) and 60 bar(a).

23. The method according to claim 3, wherein the first expansion device comprises at least two turbo expanders, wherein the first partial stream is expanded in a first turbo-expander of the first expansion device to the intermediate pressure and further to the second pressure in a second turbo-expander of the first expansion device, wherein the guiding of the intermediate first partial stream and the second partial stream such that heat can indirectly be transferred between said intermediate first partial stream and said second partial stream occurs after expansion in said first turbo-expander and prior to expansion in said second turbo-expander.

24. The method according to claim 1, wherein the first refrigerant stream comprises at least 80 mol. % hydrogen, and the second refrigerant comprises 18 mol. % to 23 mol. % nitrogen, and/or 27 mol. % to 29 mol. % methane, and/or 24 mol. % to 37 mol. % ethane, and/or 18 mol. % to 24 mol. % isopentane or isobutane, wherein the sum of the concentrations of the components does not exceed 100 mol %.

* * * * *